US005292384A

United States Patent [19]

Klueh et al.

[11] Patent Number: 5,292,384

[45] Date of Patent: Mar. 8, 1994

[54] CR-W-V BAINITIC/FERRITIC STEEL WITH IMPROVED STRENGTH AND TOUGHNESS AND METHOD OF MAKING

[75] Inventors: Ronald L. Klueh, Knoxville; Philip J. Maziasz, Oak Ridge, both of Tenn.

[73] Assignee: Martin Marietta Energy Systems, Inc., Oak Ridge, Tenn.

[21] Appl. No.: 914,452

[22] Filed: Jul. 17, 1992

[51] Int. Cl.[5] ..... C22C 38/22; C21D 6/00

[52] U.S. Cl. ..... 148/333; 148/334; 148/660; 148/663; 148/637

[58] Field of Search ..... 420/111, 114; 148/330, 148/333, 334, 660, 663, 633, 637

[56] References Cited

U.S. PATENT DOCUMENTS

| | | | |
|---|---|---|---|
| 2,572,191 | 10/1951 | Payson | 420/114 |
| 2,905,577 | 9/1959 | Harris et al. . | |
| 4,075,041 | 2/1978 | Ueno et al. . | |
| 4,088,511 | 5/1978 | Rowney | 148/333 |
| 4,295,902 | 10/1981 | Economapoulas | 148/663 |
| 4,328,032 | 5/1982 | Mancini et al. . | |
| 4,826,543 | 5/1989 | Yano et al. . | |
| 4,946,516 | 8/1990 | Yano et al. . | |

FOREIGN PATENT DOCUMENTS

| | | | |
|---|---|---|---|
| 0523801 | 2/1956 | Belgium . | |
| 647987 | 5/1964 | Belgium . | |
| 0231864 | 8/1987 | European Pat. Off. . | |
| 861706 | 1/1951 | Fed. Rep. of Germany . | |
| 917674 | 9/1954 | Fed. Rep. of Germany . | |
| 945150 | 1/1956 | Fed. Rep. of Germany . | |
| 1483210 | 3/1969 | Fed. Rep. of Germany . | |
| 2408721 | 10/1974 | Fed. Rep. of Germany . | |
| 47-3383 | 1/1972 | Japan . | |
| 52-13418 | 2/1977 | Japan . | |
| 55-24932 | 2/1980 | Japan | 148/660 |
| 57-051243 | 3/1982 | Japan . | |
| 59-185760 | 10/1984 | Japan . | |
| 60-245768 | 12/1985 | Japan . | |
| 61-079745 | 4/1986 | Japan . | |
| 61-117245 | 6/1986 | Japan . | |
| 61-221354 | 10/1986 | Japan . | |
| 61-238940 | 10/1986 | Japan . | |
| 62-142726 | 6/1987 | Japan . | |
| 63-169359 | 7/1988 | Japan . | |
| 1-142023 | 6/1989 | Japan . | |
| 2-194115 | 7/1990 | Japan . | |
| 2-220735 | 9/1990 | Japan . | |
| 3-202422 | 9/1991 | Japan . | |
| 377540 | 6/1964 | Switzerland . | |
| 168323 | 11/1965 | U.S.S.R. . | |
| 271807 | 1/1969 | U.S.S.R. . | |
| 272564 | 6/1970 | U.S.S.R. . | |
| 441336 | 5/1973 | U.S.S.R. . | |
| 982955 | 2/1965 | United Kingdom . | |
| 1060605 | 3/1967 | United Kingdom . | |
| 1176855 | 1/1970 | United Kingdom . | |
| 1235220 | 6/1971 | United Kingdom . | |
| 1248434 | 10/1971 | United Kingdom . | |
| 1253552 | 11/1971 | United Kingdom . | |
| 1253739 | 11/1971 | United Kingdom . | |
| 1253740 | 11/1971 | United Kingdom . | |
| 1338285 | 11/1973 | United Kingdom . | |
| 2122644 | 1/1984 | United Kingdom . | |
| 2244718 | 12/1991 | United Kingdom . | |

OTHER PUBLICATIONS

Stahl und Eisen, vol. 104, No. 22, Oct. 29, 1984, Dusseldorf, DE, pp. 1176–1184; Bechet et al.: "Verschleissbestandige Bleche", pp. 1182–1183; table 1, 2: Steel Usirac 320; VSS 10 and Armco SSS.

(List continued on next page.)

*Primary Examiner*—Deborah Yee

*Attorney, Agent, or Firm*—Edward A. Pennington; Joseph A. Marasco; Harold Adams

[57] ABSTRACT

A high strength, high toughness Cr-W-V ferritic steel composition suitable for fast induced-radioactivity (FIRD) decay after irradiation in a fusion reactor comprises 2.5–3.5 wt % Cr, 2.0–3.5 wt % tungsten, 0.10–0.30 wt % V and 0.1–0.15 wt % C. The ferritic steel for FIRD nuclear fusion, heat resisting structural applications may also contain minor amounts of alloying elements including 0.003–0.009 wt % B, 0.05–0.15 wt % Ta and 0–0.2 wt % Ti. The ferritic steel for nuclear fission and for non-nuclear, heat resisting applications can, in addition to the above alloying elements, also include 0–0.5 wt % Mo and 0.05–0.25 wt % Nb. The alloys are prepared by austenitizing and either normalizing or quenching followed by a low temperature temper.

20 Claims, 10 Drawing Sheets

OTHER PUBLICATIONS

Patent Abstracts of Japan, vol. 11, No. 369, (C-461)(2816), Dec. 2, 1987 of JP-A-62 142 726, (Kobe Steel).

Patent Abstracts of Japan, vol. 12, No. 446, (C-546)(3293), Nov. 24, 1988 of JP-A-63 169 359, (Sumitomo Metal).

Patent Abstracts of Japan, vol. 13, No. 399, (C-632)(3747), Sep. 5, 1989 of JP-A-142 023, (Kobe Steel), Jun. 2, 1989.

World Patents Index, Week 7130, Derwent Publications Ltd., London, GB; AN 71-50199S of JP-B-46 026 212, (Sumitomo Metal), 1971.

Patent Abstracts of Japan, vol. 6, No. 174, (C-123)(1052), Sep. 8, 1982 of JP-A-57 089 426, (Shin Nippon Seitetsu).

Patent Abstracts of Japan, vol. 12, No. 312, (C-523), Aug. 24, 1988 of JP-A-63 083 225, (Kawasaki Steel).

Patent Abstracts of Japan, vol. 11, No. 273, (C-445), Sep. 4, 1987 of JP-A-62 077 416, (Kawasaki Steel).

R. L. Klueh, *Chromium-Molybdenum Steel for Fusion Reactor First Walls—A Review**, Jun. 1982, Oak Ridge National Laboratory, Oak Ridge, Tenn.

R. L. Klueh and A. M. Nasreldin, *Microstructure and Mechanical Properties of a 3Cr-1.5Mo Steel*, vol. 18A, Jul. 1987-1279, Oak Ridge National Lab., Oak Ridge, Tenn.

R. L. Klueh and W. R. Corwin, *Impact Behavior of Cr-W Steels*[1], J. Materials Engineering, vol. 11, No. 2, 1989.

R. L. Klueh and E. E. Bloom, *The Development of Ferritic Steels for Fast Induced-Radioactivity Decay for Fusion Feactor Applications**, Apr. 21, 1985.

R. L. Klueh, *Heat Treatment Behavior and Tensile Properties of Cr-W Steels*, vol. 20A, Mar. 1989-463.

J. M. Vitek, W. R. Corwin, R. L. Klueh, & J. R. Hawthorne, *On the Saturation of the DBTT Shift of Irradiated 12Cr-1Mo VW with Increasing Fluence**, Elsevier Publishers.

YS OF Cr-Mo AND Cr-W STEELS AT RT

USE OF Cr-Mo AND Cr-W STEELS

CR-W-V BAINITIC/FERRITIC STEEL WITH IMPROVED STRENGTH AND TOUGHNESS AND METHOD OF MAKING

This invention was made with Government support under contract DE-AC05-840R21400 awarded by the U.S. Department of Energy to Martin Marietta Energy Systems, Inc. and the Government has certain rights in this invention.

FIELD OF THE INVENTION

The present invention relates generally to ferritic steel alloys and, more specifically, to a high strength, high toughness Cr-W-V ferritic steel alloy having a carbide-free acicular bainite microstructure achieved through the alloy composition and by controlling the cooling rate from an austenitizing temperature.

BACKGROUND OF THE INVENTION

Ferritic steels are attractive because of low cost, ease of fabrication, low thermal expansion and good thermal conductivity, but are limited by high-temperature strength and low-temperature toughness. For many modern applications, heat-resisting, structural steel alloys are required that have both high strength and high toughness. While it is desirable to produce a steel having both characteristics, in practice, the improvement in one characteristic usually comes at the expense of the other. Toughness is an intrinsic characteristic mechanical property typically determined by the upper-shelf energy (USE) and the ductile-brittle-transition temperature (DBTT) as measured by the Charpy impact test. The most desirable steels have a high USE and a low DBTT.

Ferritic steels, and in particular, Cr-Mo steels, have been proposed for use for the first wall and blanket structure of nuclear fusion reactors since these steels have been found to have excellent resistance to radiation-induced void swelling when irradiated in a fast fission reactor. See, for example, "Chromium-Molybdenum Steels for Fusion Reactor First Walls-A Review", by R. L. Klueh, *Nuclear Engineering and Design* 72 (1982 North-Holland Pub. Co.); "On The Saturation Of The DBTT Shift Of Irradiated 12Cr-1MoVW With Increasing Fluence", by J. M. Vitek, et al., *Journal of Nuclear Materials* 141-143 (1986); and "The Development of Ferritic Steels For Fast Induced-Radioactivity Decay For Fusion Reactor Applications", by R. L. Klueh and E. E. Bloom, *Nuclear Engineering and Design/Fusion* 2 (1985). A critical problem for nuclear fusion applications for such steels is that various alloying elements, including molybdenum, nickel, nitrogen, copper, and niobium, undergo transmutation reactions caused by irradiation from high-energy neutrons created by nuclear reactions in a fusion plasma. These elements, when used in alloys to make fusion reactor components, produce highly radioactive isotopes that decay over a long period of time. Thus, after the service lifetime of the reactor, deep geological disposal of the radioactive components becomes necessary.

To simplify waste disposal, new structural materials known as "low activation" or "reduced-activation" or "fast induced-radioactivity decay" (FIRD) alloys have been proposed. Such new alloys should at least meet guidelines issued by the U.S. Nuclear Regulatory Commission (10 CFR Part 61) for shallow land burial, instead of the much more expensive deep geologic disposal. Decay to low radioactivity levels for such FIRD alloys would occur in tens of years instead of the hundreds or thousands of years required for conventional steels. Thus, FIRD alloys must not contain molybdenum or other alloying elements which produce long-lived radioactive isotopes when used in nuclear fusion applications.

The need for both strength and toughness is also important for nuclear fission and non-nuclear, elevated-temperature structural heat-resisting steel applications. A low DBTT is required because steels can become embrittled by an increase in the DBTT after prolonged exposure to elevated temperatures. Therefore, low-chromium steels having high strength and toughness will have many non-nuclear applications, such as in power generation systems or chemical reaction vessels, where the 2.25Cr-1Mo ferritic steel is used extensively.

Three commercial Cr-Mo steels presently available for non-nuclear applications are 2.25Cr-1Mo (Fe-2.25%Cr-1%Mo-0.1%C), 9Cr-1MoVNb (Fe-9%Cr-1%Mo-0.25%V-0.07%Nb-0.1%C), and 12 Cr-1MoVW (Fe- 12%Cr-1%Mo-0.25%V-0.5%W-0.5%Ni-0.2%C) wherein all concentrations are in weight percent. The molybdenum, niobium, and nickel content keep these commercial steels from being FIRD steels for nuclear fusion applications. The 9Cr-1MoVNb and 12Cr-1MoVW steels have better elevated temperature strength and oxidation resistance than 2.25Cr-1Mo steel. However, the relatively high concentration of chromium in these steels is not desirable, particularly for fusion reactor applications, due to their relatively poor weldability. Also, since chromium is expensive and a strategic element of uncertain supply, steels requiring less chromium would naturally be desirable.

Cr-W steels have been considered for making structural components of fusion reactors, including the following alloys: 2.25Cr-2W; 2.25Cr-2WV; 2.25Cr-1WV; 2.25CrV; 9Cr-2WVTa; and 12Cr-2WV. Properties of these steel alloys are discussed in "Impact Behavior of Cr-W Steels", by R. L. Klueh and W. R. Corwin, *J. Materials Engineering*, Vol. 11, No. 2 (1989); and "Heat Treatment Behavior and Tensile Properties of Cr-W Steels", by R. L. Kleuh, *Metallurigcal Transactions A*, Vol. 20A, March 1989. The 9Cr-2WVTa described therein had the best combination of strength and toughness. The 2.25Cr-2WV steel had the best strength, but toughness was poor, thus making it unsuitable for fusion applications. It was concluded that the reason for the high DBTT for the 2.25Cr-2WV involved the low hardenability of the steel, which leads to the steel having a duplex structure of bainite and polygonal ferrite after normalization as 15.9 mm thick plate, compared to the 2.25Cr-2W, which was 100% bainite and has a lower DBTT. However, even when the 2.25Cr-2WV was heat treated to produce 100% bainite by cooling thin sections, it still did not exhibit the good toughness of the 2.25Cr-2W and 9Cr-2WVTa steels. The 2.25Cr-2W steel was determined to be less attractive because of its low strength.

SUMMARY OF THE INVENTION

One object of the present invention is to provide a low-chromium ferritic steel with strength similar to or better than the 2.25Cr-2WV steel and the commercial 9Cr-1MoVNb and 12Cr-1MoVW steels, but with toughness as good as or better than that of the 2.25Cr-2W, 9Cr-2WVTa, 9Cr-1MoVNb and 12Cr-1MoVW steels.

Another object of the present invention is to provide a ferritic steel alloy having a low DBTT and high USE with minimal (or perhaps without) tempering, thus allowing for high strength and toughness with minimum heat treatment or in the as-welded condition.

These and other objects are met by providing a ferritic steel alloy which includes by weight 2.75–4.0Cr, 2–3.5W, 0.10–0.30V, and 0.10–0.15C, with the remainder being substantially Fe, wherein the alloy is heated to an austenitizing temperature, and then cooled to a bainite transformation temperature regime at a rate sufficient to produce carbide-free acicular bainite.

The addition of minor amounts of Ti, Ta, Si, and B can be accommodated in the alloy and remain a FIRD steel. For non-nuclear fusion application, minor amounts of Mo, N, and Ni can be tolerated and some combinations will be used for both applications.

Another aspect of the present invention is to provide a method for making a ferritic steel alloy which includes melting and casting a composition which includes by weight percent 2.75–4.0Cr, 2.0–3.5W, 0.10–0.30V, 0.10–0.15C, with the remainder being substantially Fe, heating the cast composition or wrought/processed material with same composition to an austenitizing temperature, and cooling the heated composition to a bainite transformation temperature regime at a rate sufficient to produce carbide-free acicular bainite.

Other objects, advantages and salient features of the invention will become apparent from the following detailed description, which, taken in conjunction with the annexed drawings, discloses preferred embodiments of the invention.

DETAILED DESCRIPTION OF THE PREFERRED EMBODIMENTS

Although optical microscopy of the 2.25Cr-2W and 2.25Cr-2WV indicated tempered bainite microstructures, more subtle differences became apparent from transmission electron microscopy (TEM). Elongated precipitates and substructure appeared in the 2.25Cr-2W steel, as shown in FIG. 1(*a*), giving evidence of a lath-like microstructure before tempering. Precipitates in 2.25Cr-2WV were globular and formed in patches in a more equiaxed substructure, as shown in FIG. 1(*b*). These differences are likely caused by the different kinds of bainite (termed carbide-free acicular bainite and granular bainite) that form when these steels are normalized (a steel is "normalized" by first austenitizing and then air cooling). This difference is associated with hardenability and how rapidly the steels are cooled from the austenitizing temperature.

Bainite forms in the range of about 250 to 500° C. and is generally defined as a microstructure that contains carbides in a ferrite matrix that contains a high dislocation density. Bainite was originally thought to consist of only two morphological variations, upper and lower bainite, which were defined according to the temperature of formation. Classical upper and lower bainite can be differentiated by the appearance of the carbide particles relative to the axis of the bainitic ferrite plate or needle. Upper bainite forms as a collection of ferrite plates or laths with carbide particles parallel to the plates. Lower bainite consists of plates or needles with carbides forming within the ferrite at about a 60° angle to the axis of the plate or needle. Morphological variations have been found that differ from upper and lower bainite, although they form in the bainite transformation temperature regime. Such bainites were found to form more easily during continuous cooling than during an isothermal transformation, where classical bainites are generally formed.

Classical upper and lower bainite microstructures form when isothermally transformed in different temperature regimes of the bainite transformation temperature region as defined on an isothermal transformation (IT) diagram. This means that the bainite transformation region of an IT diagram can be divided into two temperature regimes, as shown in FIG. 2(*a*).

Figure 2A:
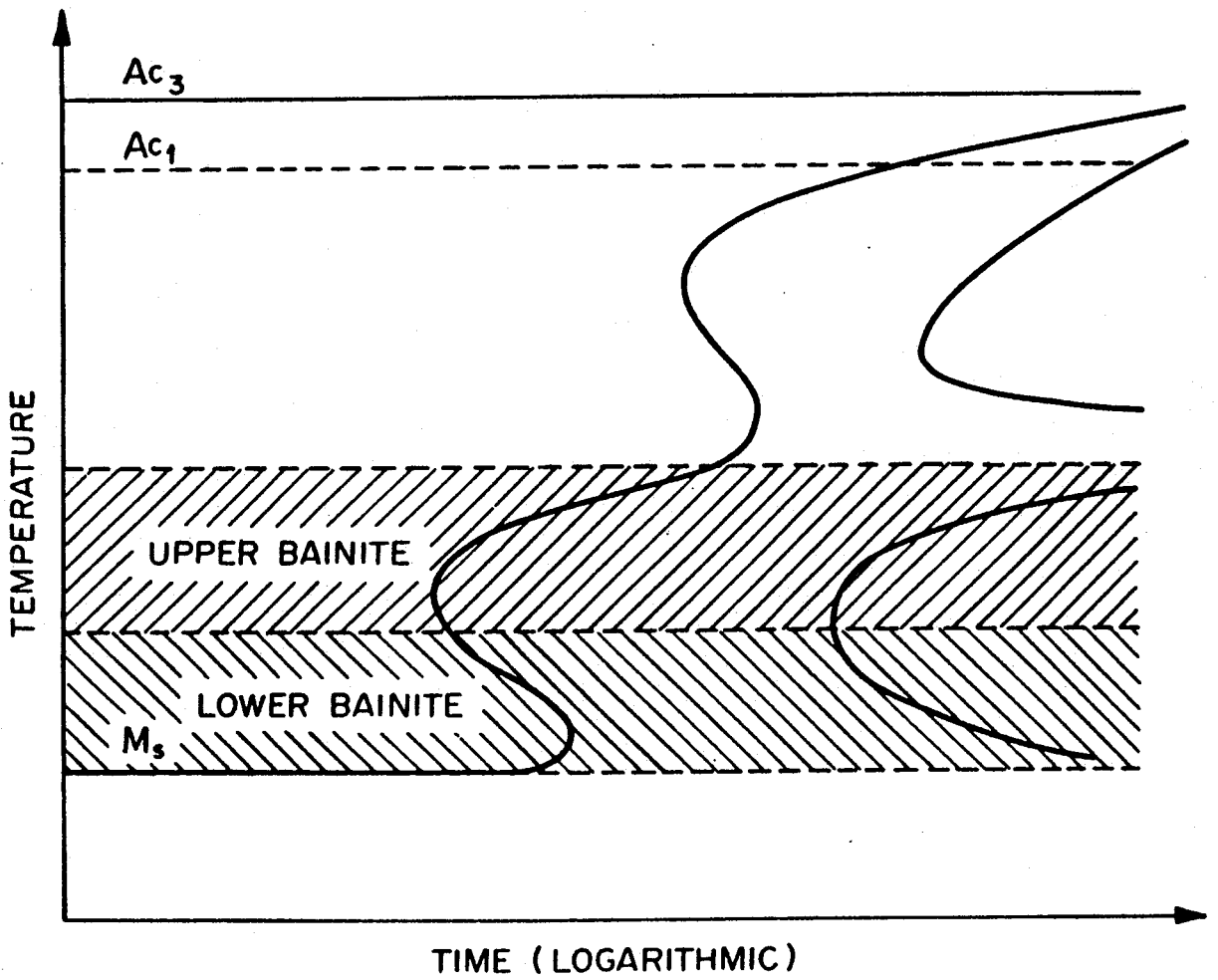
FIGS. 2(*a*) and 2(*b*) schematically illustrate an isothermal transformation diagram and a continuous cooling transformation diagram, respectively, for low-carbon alloy steels.
Figure 2B:
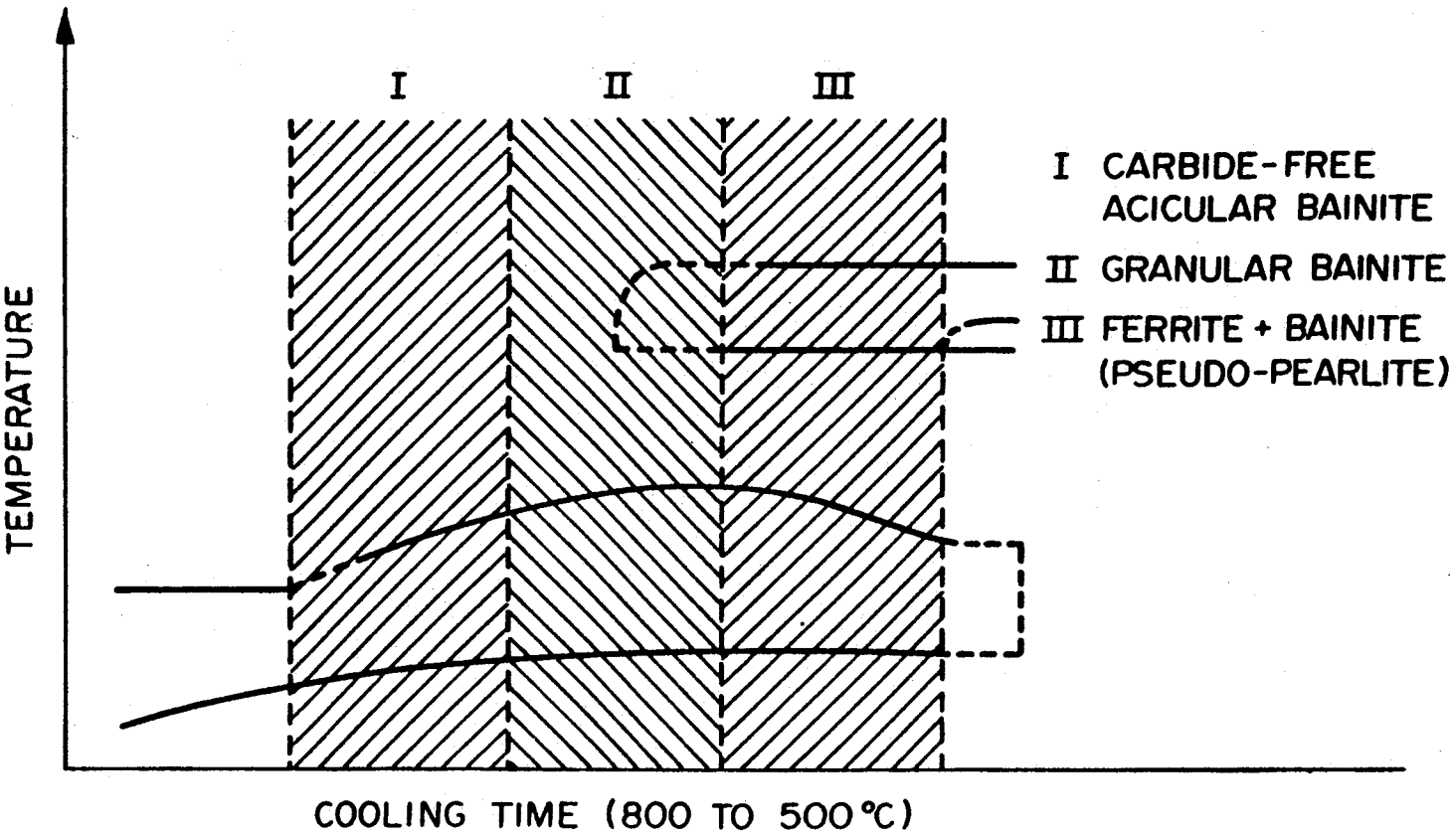

For nonclassical bainites, it has been shown that a continuous cooling transformation (CCT) diagram could be divided into three vertical cooling rate regimes, as shown in FIG. 2(*b*). Different nonclassical bainite microstructures form when cooling rates are such as to pass through these zones. A steel cooled rapidly enough to pass through zone I produces a carbide-free acicular structure which consists of side-by-side plates or laths. When cooled through zone II a carbide-free massive or granular structure results, generally called granular bainite. Granular bainite consists of a ferrite matrix with a high dislocation density that contains martensite-austenite (M-A) "islands".

Figure 3A:
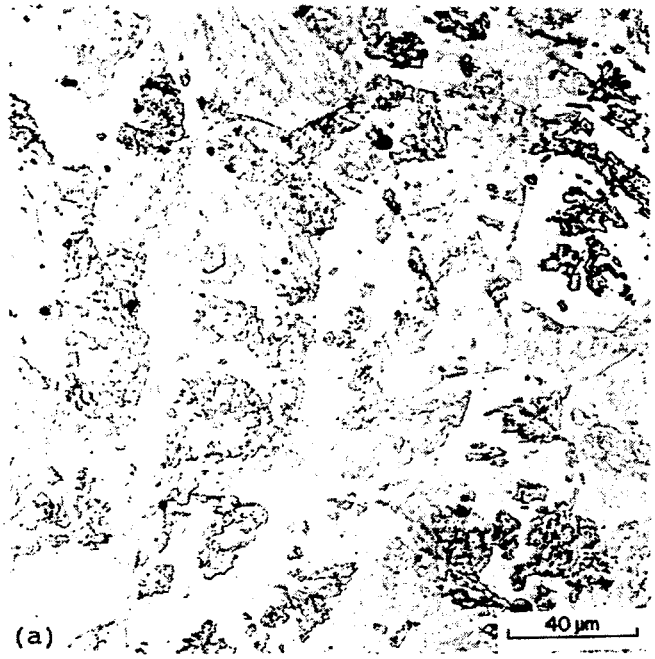
FIGS. 3(*a*) and 3(*b*) are photomicrographs of normalized 2.25Cr-2WV steel after a slow cool and a fast cool, respectively, from 1050° C.
Figure 3B:
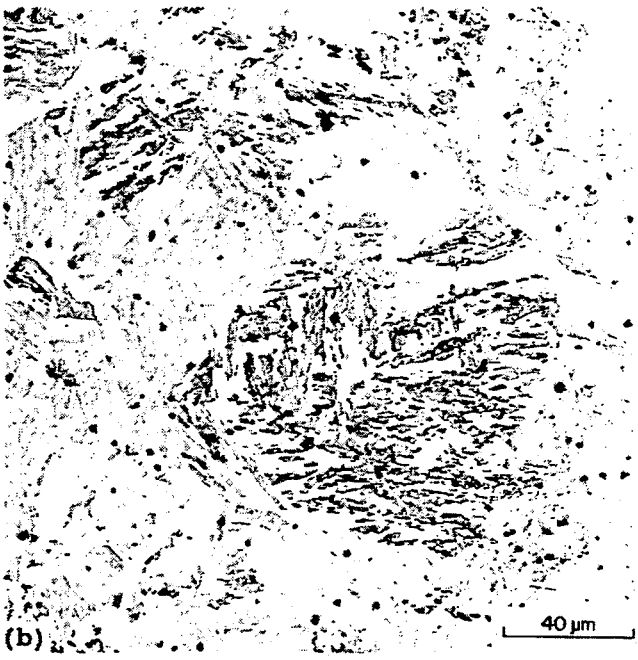

To demonstrate the effect of cooling rate on microstructure, pieces of standard-size and ⅓-size Charpy specimens of 2.25Cr-2W and 2.25Cr-2WV were normalized by heating in a helium atmosphere in a tube furnace and then pulled into the cold zone. To speed the cooling of the small specimen, it was cooled in flowing helium. The large specimen was cooled in static helium to further slow the cooling relative to the small specimen. Optical metallography indicated specimens were 100% bainite after the fast and the slow cools, although there were differences in appearance as seen for 2.25Cr-2WV in FIGS. 3(*a*) and 3(*b*). FIG. 3(*a*) shows a slow cool from 1050° C., while FIG. 3(b) shows a fast cool from the same temperature. The specimen given the faster cooling rate exhibits a more acicular structure.

Figure 4A:
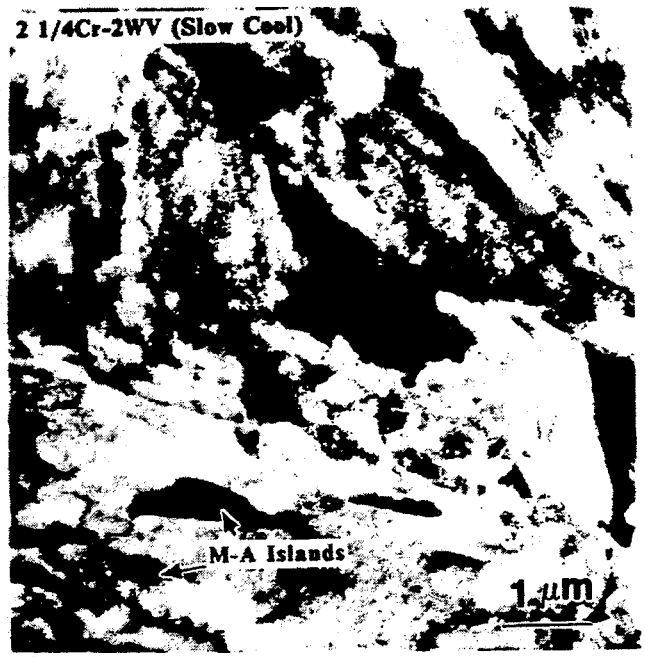
FIGS. 4(*a*) and 4(*b*) are photomicrographs of bainitic microstructures of normalized 2.25Cr-2WV steel after a slow cool and a fast cool, respectively, from 1050° C.
Figure 4B:
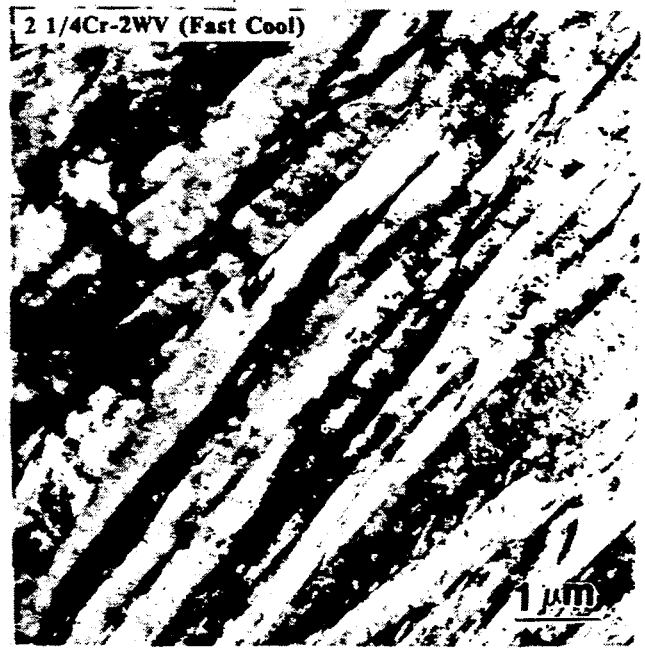

Microstructures observed by TEM on the 2.25Cr-2WV slow cooled and fast cooled from 1050° C. are shown in FIGS. 4(*a*) and 4(*b*), respectively. The slowly cooled specimen is characteristic of granular bainite—the dark areas are M-A islands. Micrographs of the specimens cooled rapidly are characteristic of carbide-free acicular bainite.

Figure 1A:
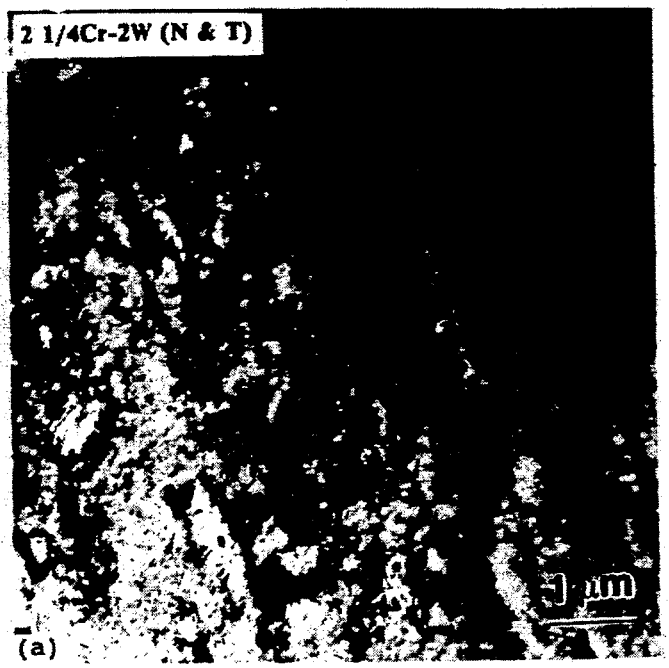
FIGS. 1(*a*) and 1(*b*) are photomicrographs of the bainitic microstructures of normalized-and-tempered 2.25Cr-2W and 2.25Cr-2WV alloys, respectively.
Figure 1B:
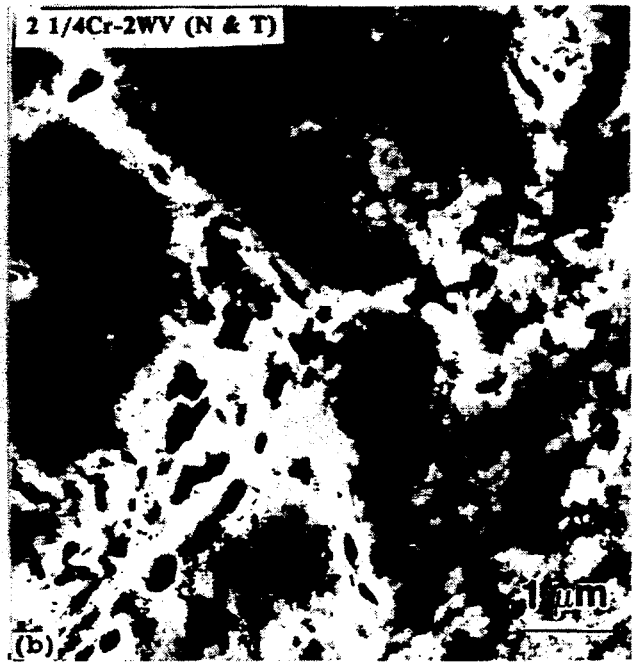

Based on the above discussion, the difference in microstructures seen in FIGS. 1(a) and 1(b) indicate that the 2.25Cr-2W contained carbide-free acicular bainite and 2.25Cr-2WV contained granular bainite. As discussed below, observations on the effect of tempering on toughness further enhanced that view.

Tempering at 750° C. significantly improved the DBTT of the 2.25Cr-2WV alloy over the value obtained by tempering at 700° C. and the DBTT of the 2.25Cr-2W was little changed from the value obtained at 700° C. by tempering at 750° C. Previous work described in "Microstructure and Mechanical Properties of a 3Cr-1.5Mo Steel", By R. L. Klueh and A. M. Nasreldin, *Metallurgical Transactions A* (vol. 18a, July 1987) on a Cr-Mo steel indicated that for carbide-free acicular bainite, a high toughness (high USE and low DBTT) was achieved after tempering at a lower temperature or for a shorter time than for granular bainite. This resulted in a higher strength and toughness for the acicular bainite. Also, once these properties were reached for the acicular bainite, further tempering had little additional effect on toughness. This explains the difference in the effect of tempering on the DBTT of the 2.25Cr-2W (carbide-free acicular) and 2.25Cr-2WV (granular bainite).

These results indicate that differences between the impact behavior of 2.25Cr-2WV and 2.25Cr-2W also involved differences in microstructure. The 2.25Cr-2WV was austenitized at 1050° C. and the 2.25Cr-2W at 900° C. The higher temperature was necessary for the vanadium-containing steel to ensure that all vanadium carbide dissolved in solid solution during austenitization. This higher austenitizing temperature was concluded to result in a longer cooling time to reach the bainite transformation temperature regime, which results in granular bainite for thin sections and granular bainite and polygonal ferrite for thicker sections of 2.25-Cr2WV.

The present invention avoids the formation of granular bainite by increasing the hardenability of the steel thus enhancing the possibility of cooling the alloy from an austenitizing temperature through zone I of the CCT diagram to ensure formation of carbide-free acicular bainite. An improved hardenability coincides with the movement of the ferrite and bainite transformation curves to longer times as represented by a CCT diagram such as FIG. 2(*b*). In other words, by increasing the hardenability of the steel, the transformation regions of FIG. 2(*b*) will all shift to the right, thus allowing for a slower cooling rate for the steel to be cooled through zone I to form carbide-free acicular bainite.

Hardenability is increased according to the present invention by alloying within specific ranges with certain elements. Carbon is known to have a large effect on hardenability, but it can adversely affect the weldability. Thus, the carbon level should be kept in the range of 0.10 to 0.15 weight percent. Instead, further additions of chromium and tungsten were made to the 2.25Cr-2W and 2.25Cr-2WV compositions to improve the hardenability.

EXAMPLE I

Several alloy compositions, according to the present invention, having 3Cr are listed in Table 1. This group of alloys contained 3% Cr and either 2 or 3% W, and was compared to a second group containing 2.25Cr and small amounts of titanium, tantalum and boron.

Alloys containing Fe, Cr, W, V, and C were prepared by melting, casting and fabricating the alloys into test samples. The nominal composition of the major alloying elements and alloy designations are given in Table 1.

The specimens were prepared by forming a sample from the alloy, and normalizing and tempering. The specimens were normalized by austenitizing the specimen in a helium atmosphere for 0.5 hr. at 1050° C. for steels containing vanadium and 0.5 hr. at 900° C. for those without vanadium. The higher temperature was required for the steels containing vanadium to ensure all the vanadium carbide dissolves during austenitization. The specimens were annealed in a tube furnace and then rapidly cooled by pulling them from the furnace into a helium atmosphere chamber attached to the furnace. Specimens were then tempered by heating for 1 hr. at 700° C. and for 1 hr. at 750° C.

TABLE 1

NOMINAL COMPOSITION OF MAJOR ELEMENTS FOR STEELS

| Alloy | Nominal chemical composition*, wt % | | | | | | |
|---|---|---|---|---|---|---|---|
| Designation | Cr | W | V | Ti | Ta | C | B |
| 2.25Cr—2WTi | 2.25 | 2.0 | | 0.02 | | 0.1 | |
| 2.25Cr—2WVTi | 2.25 | 2.0 | 0.25 | 0.02 | | 0.1 | |
| 2.25Cr—2WVTa | 2.25 | 2.0 | 0.25 | | 0.07 | 0.1 | 0.005 |
| 2.25Cr—2WVB | 2.25 | 2.0 | 0.25 | | | 0.1 | 0.005 |
| 2.25Cr—2WVTaB | 2.25 | 2.0 | 0.25 | | 0.07 | 0.1 | |
| 3Cr—2W | 3.0 | 2.0 | | | | 0.1 | |
| 3Cr—3W | 3.0 | 3.0 | | | | 0.1 | |
| 3Cr—2WV | 3.0 | 2.0 | 0.25 | | | 0.1 | |
| 3Cr—3WV | 3.0 | 3.0 | 0.25 | | | 0.1 | |

*Balance iron

Each specimen was tested for yield stress (YS) and ultimate tensile strength (UTS), andelongation (El). Tensile and Charpy impact specimens were machined from small button heats of the alloys. The sheet tensile specimens with a reduced gage section 7.62 mm long by 1.52 mm wide by 0.76 mm thick were tested. Miniature Charpy specimens essentially one third the standard size were used measuring 3.3 mm by 3.3 mm wide by 25.4 mm with a 0.51 mm deep 30° V-notch having a 0.05 to 0.08 mm root radius. DBTT and USE values were obtained for each specimen. Although different DBTT and USE values apply for standard Charpy specimens, a DBTT and USE value for the miniature specimens translates to a comparable value for a standard specimen (10 mm by 10 mm by 55 mm).

Tensile and impact properties are given in Tables 2 and 3, respectively. Properties are given after 700° C. and 750° C. tempering treatments. Room temperature strengths are given in Table 2 and they indicate that the 3Cr-2W and 3Cr-3W steels have strengths comparable to those of 2.25Cr-2W. The strength of 3Cr-2WV is somewhat less than that of 2.25Cr-2WV, but the strength of the 3Cr-3WV is similar to that of 2.25Cr-2WV.

The data of Table 3 demonstrate that increasing the chromium content from 2.25wt % to 3.0wt % caused significant improvements in the impact properties of the steel. Of special interest is the fact that the 3% Cr steels have exceedingly low DBTT values after tempering at 700° C., indicating that increasing the hardenability has improved toughness.

TABLE 2

ROOM TEMPERATURE TENSILE DATA

| Alloy Designation | Tempered at 700° C. YS (MPa) | UTS (MPa) | El (%) | Tempered at 750° C. YS (MPa) | UTS (MPa) | El (%) |
|---|---|---|---|---|---|---|
| 2.25Cr—2W | 594 | 677 | 9.5 | 554 | 626 | 13.2 |
| 2.25Cr—2WV | 889 | 978 | 7.5 | 684 | 758 | 9.8 |
| 3Cr—2W | 592 | 709 | 10.2 | 520 | 642 | 11.4 |
| 3Cr—3W | 606 | 730 | 9.9 | 505 | 656 | 11.8 |
| 3Cr—2WV | 781 | 865 | 7.8 | 590 | 689 | 9.4 |
| 3Cr—3WV | 868 | 953 | 7.8 | 604 | 710 | 8.8 |
| 2.25Cr—2WTi | 552 | 644 | 11.3 | 494 | 597 | 12.5 |
| 2.25Cr—2WVTi | 787 | 864 | 7.9 | 552 | 644 | 10.0 |
| 2.25Cr—2WVTa | 908 | 979 | 7.9 | 621 | 716 | 10.6 |
| 2.25Cr—2WVB | 804 | 889 | 8.6 | 598 | 691 | 10.7 |
| 2.25Cr—2WVTaB | 876 | 951 | 7.6 | 664 | 739 | 9.6 |

HEAT TREATMENTS

The 2.25Cr—2W, 3Cr—2W, and 3Cr—3W were austenitized 0.5 hr. at 900° C. All other steels were austenitized 0.5 hr. at 1050° C.

TABLE 3

CHARPY IMPACT DATA

| Alloy Designation | Tempered at 700° C. DBTT (°C.) | USE (J) | Tempered at 750° C. DBTT (°C.) | USE (J) |
|---|---|---|---|---|
| 2.25Cr—2W | −56 | 11.5 | −77 | 10.1 |
| 2.25Cr—2WV | 10 | 8.4 | −78 | 12.7 |
| 3Cr—2W | −126 | 11.9 | −115 | 12.2 |
| 3Cr—3W | −65 | 11.0 | −85 | 13.1 |
| 3Cr—2WV | −36 | 8.9 | −85 | 14.7 |
| 3Cr—3WV | −70 | 10.7 | −130 | 13.5 |
| 2.25Cr—2WTi | −74 | 10.9 | −68 | 10.5 |
| 2.25Cr—2WVTi | −50 | 10.8 | −70 | 10.6 |
| 2.25Cr—2WVTa | −10 | 9.2 | −65 | 13.6 |
| 2.25Cr—2WVB | −21 | 8.1 | −90 | 11.5 |
| 2.25Cr—2WVTaB | −30 | 7.7 | −78 | 11.7 |

HEAT TREATMENTS

The 2.25Cr—2W, 3Cr—2W, and 3Cr—3W were austenitized 0.5 hr. at 900° C. All other steels were austenitized 0.5 hr. at 1050° C.

Figure 5A:
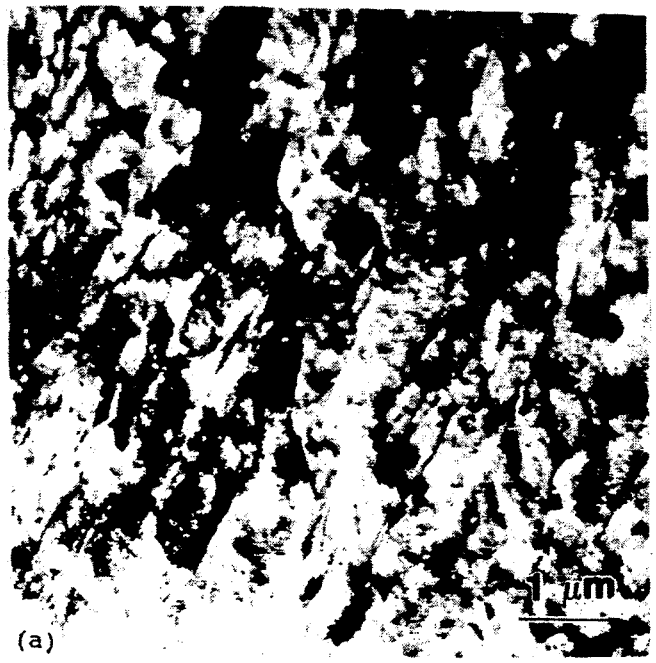
FIGS. 5(*a*) and 5(*b*) are photomicrographs of the bainitic microstructures of normalized 3Cr-2W and 3Cr-3W steels, respectively.
Figure 5B:
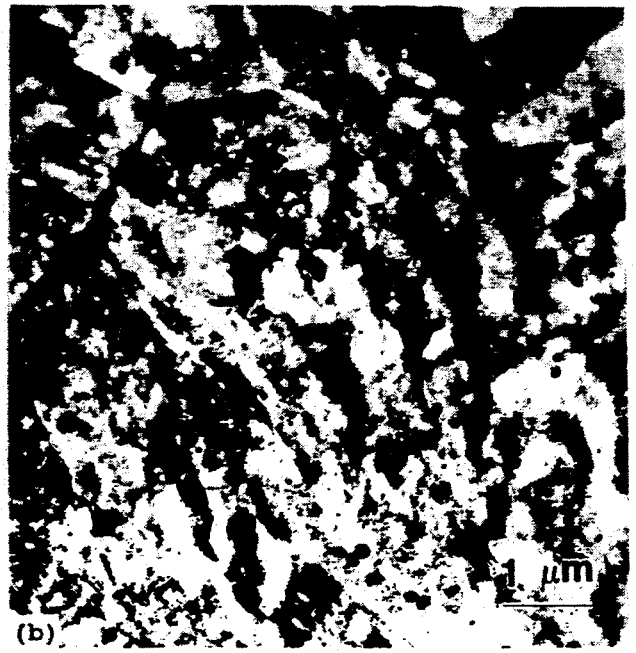
Figure 6A:
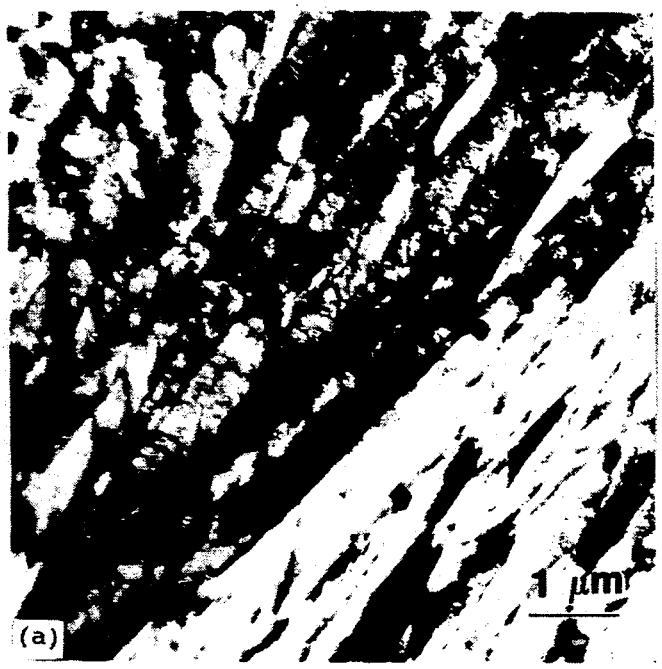
FIGS. 6(*a*) and 6(*b*) are photomicrographs of the bainitic microstructure of normalized 3Cr-2WV and 3Cr-3WV steels, respectively.
Figure 6B:
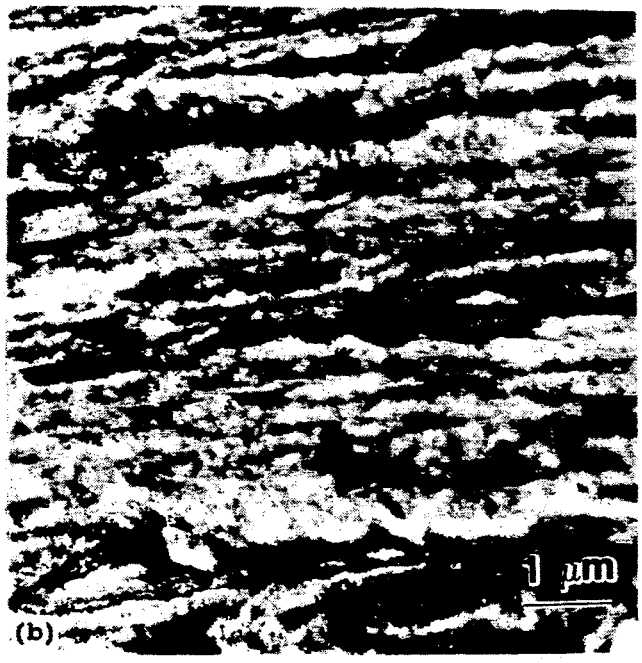

The data further show a higher DBTT for the 3Cr-3W steel relative to the 3Cr-2W steel, even though the 3Cr-3W has a higher hardenability. The reason for this behavior is that the 3Cr-2W steel was mostly acicular bainite as seen when the microstructure of the 3Cr-2W steel was examined by TEM as shown in FIG. 5(*a*). The 3Cr-3W steel when normalized showed a significant amount of coarse precipitate as evidenced by the TEM of FIG. 5(*b*). It is believed the additional tungsten in the absence of vanadium induces the formation of the precipitate, which inhibits the formation of the acicular bainite and results in lower toughness. When the 3Cr-2WV and 3Cr-3WV specimens were examined by TEM, carbide-free acicular microstructures were observed, as shown in FIGS. 6(*a*) and 6(*b*), respectively. For these steels, the hardenability of the 3Cr-3WV is better than the 3Cr-2WV and exhibits improved toughness.

A significant result of this example shows that the 3Cr steels all had low DBTT after tempering at 700° C. Based on these observations, it should be possible to use still lower tempering temperatures and still have adequate toughness. Furthermore, the relatively minor effect of tempering on toughness means that it may be possible to use the steel in the untempered condition for some applications. Use of a lower tempering temperature or no tempering thus produces a steel having significantly higher strength with acceptable toughness.

Tests were performed on 2.25Cr steels with small additions of titanium, tantalum, and boron, with the results reported in Tables 2 and 3. The 0.07% Ta led to a slight increase in strength, whereas the 0.02% Ti resulted in some improvement in the toughness. The combined additions of tantalum and boron resulted in good strength and toughness, indicating that this combination of elements would also improve the properties of 3Cr steels that had an acicular bainite microstructure.

The strength of the 3Cr-3WV steel approaches that of the 2.25Cr-2WV steel, and it therefore has strength comparable to the strength of 9Cr-1MoVNb and 12Cr-1MoVW steels.

EXAMPLE II

In this example, the room-temperature strength and low-temperature toughness of the novel steels are compared with the strength and toughness of high and low chromium steels containing molybdenum. The specimens were prepared as in Example I by melting the alloy and preparing test samples. The nominal composition of the alloying elements and alloy designation are shown in Table 4.

The specimens were prepared by forming a sample from the alloy, normalizing and tempering. The 2.25Cr-1Mo steel was austenitized at 900° C. for 0.5 hr. The other steels were austenitized at 1050° C. for 0.5 hr. The steels were then tempered for 1 hr. at 700° C. and 750° C. Test samples were also prepared by tempering the 9Cr-1MoVNb steel for 1 hr. at 760° C. and the 12Cr-1MoVW steel for 1 hr. at 780° C., since these temperings represent typical tempering conditions used to produce a steel having sufficient toughness for these Cr-Mo steels for most applications.

TABLE 4

NOMINAL COMPOSITION OF MAJOR ELEMENTS FOR STEELS

| Alloy Designation | Nominal chemical composition*, wt % Cr | W | V | Mo | C | Nb | Ni |
|---|---|---|---|---|---|---|---|
| 2.25Cr—1Mo | 2.25 | | | 1.0 | 0.1 | | |
| 9Cr—1MoVNb | 9.0 | | 0.25 | 1.0 | 0.1 | 0.7 | |
| 12Cr—1MoVW | 12.0 | 0.5 | 0.25 | 1.0 | 0.2 | | 0.5 |
| 3Cr—2WV | 3.0 | 2.0 | 0.25 | | 0.1 | | |
| 3Cr—3WV | 3.0 | 3.0 | 0.25 | | 0.1 | | |

*Balance iron

The yield stress, ultimate tensile strength, DBTT and USE were determined for each sample according to the process as in Example I. The 2.25Cr-1Mo, 3Cr-2WV and 3Cr-3WV steels were found to have a tempered bainitic microstructure. The 9Cr-1MoVNb and 12Cr-1MoVW steels were found to have tempered martensitic microstructures. The yield stress, ultimate tensile strength, ductile brittle transition temperature and upper-shelf energy are presented in Tables 5 and 6. For comparative purposes, the data are presented in a bar graph of FIGS. 7, 8, and 9.

The data for the 2.25Cr-1Mo steel show it to have good toughness, as determined by the low ductile-brittle transition temperature (DBTT) and high upper-shelf energy (USE) as shown in Table 6. However, as seen in Table 5, the yield stress (YS) and ultimate tensile strength (UTS) of 2.25Cr-1Mo steel after tempering at 700° C. is low in comparison to the two Cr-W steels and just comparable to that for the 9Cr-1MoVNb and 12Cr-1MoVW steels after they are tempered at 750° C.

The data presented in Table 5 indicate that the YS and UTS for the 9Cr-1MoVNb and 12Cr-1MoVW steels are comparable (approximately 5%–7% greater) to the 3Cr-2WV and 3Cr-3WV steels after the steels were normalized 0.5 hr. at 1050° C. and tempered 1 hr. at 750° C.

TABLE 5

COMPARISON OF ROOM TEMPERATURE TENSILE DATA FOR FIRD STEELS AND CONVENTIONAL Cr—Mo STEELS

| Alloy Designation | Heat Treatment[a] Tempered at 700° C. YS (MPa) | UTS (MPa) | El (%) | Tempered at 750° C. YS (MPa) | UTS (MPa) | El (%) |
|---|---|---|---|---|---|---|
| 9Cr—1MoVNb | | | | 636 | 804 | 7.8 |
| 12Cr—1MoVW | | | | 650 | 792 | 10.4 |
| 2.25Cr—1Mo | 645 | 834 | 9.6 | | | |
| 3Cr—2WV | 781 | 865 | 7.8 | 590 | 689 | 9.4 |
| 3Cr—3WV | 868 | 953 | 7.8 | 604 | 710 | 8.8 |
| | Standard Temper[b] | | | | | |
| 9Cr—1MoVNb | 541 | 656 | 9.6 | | | |
| 12Cr—1MoVW | 549 | 716 | 9.9 | | | |

[a]All steels were normalized and tempered. The 2.25Cr—1Mo was austenitized 0.5 hr. at 900° C. All other steels were austenitized 0.5 hr. at 1050° C. Tempering was 1 hr. at 700° C. and 1 hr. at 750° C.
[b]Standard Tempers: 9Cr—1MoVNb 1 hr. at 760° C.; 12Cr—1MoVW 2.5 hr. at 780° C.

TABLE 6

COMPARISON OF CHARPY IMPACT DATA FOR FIRD STEELS AND CONVENTIONAL Cr—Mo STEELS[a]

| Alloy Designation | Heat Treatment[b] Tempered at 700° C. DBTT (°C.) | USE (J) | Tempered at 750° C. DBTT (°C.) | USE (J) | Standard Temper[c] DBTT (°C.) | USE (J) |
|---|---|---|---|---|---|---|
| 9Cr—1MoVNb | 22 | 7.9 | −22 | 8.7 | −57 | 8.8 |
| 12Cr—1MoVW | 2 | 5.2 | −36 | 6.5 | −46 | 6.0 |
| 2.25Cr—1Mo | −107 | 10.7 | | | | |
| 3Cr—2WV | −36 | 8.9 | −85 | 14.7 | | |
| 3Cr—3WV | −70 | 10.7 | −130 | 13.5 | | |

One-third size Charpy specimens were tested.
[b]All steels were normalized and tempered. The 2.25Cr—1Mo was austenitized 0.5 hr. at 900° C. All other steels were austenitized 0.5 hr. at 1050° C. Tempering was 1 hr. at 700° C. and 1 hr. at 750° C.
[c]Standard Tempers: 9Cr—1MoVNb 1 hr. at 760° C.; 12Cr—1MoVW 2.5 hr. at 780° C.

Figure 7:
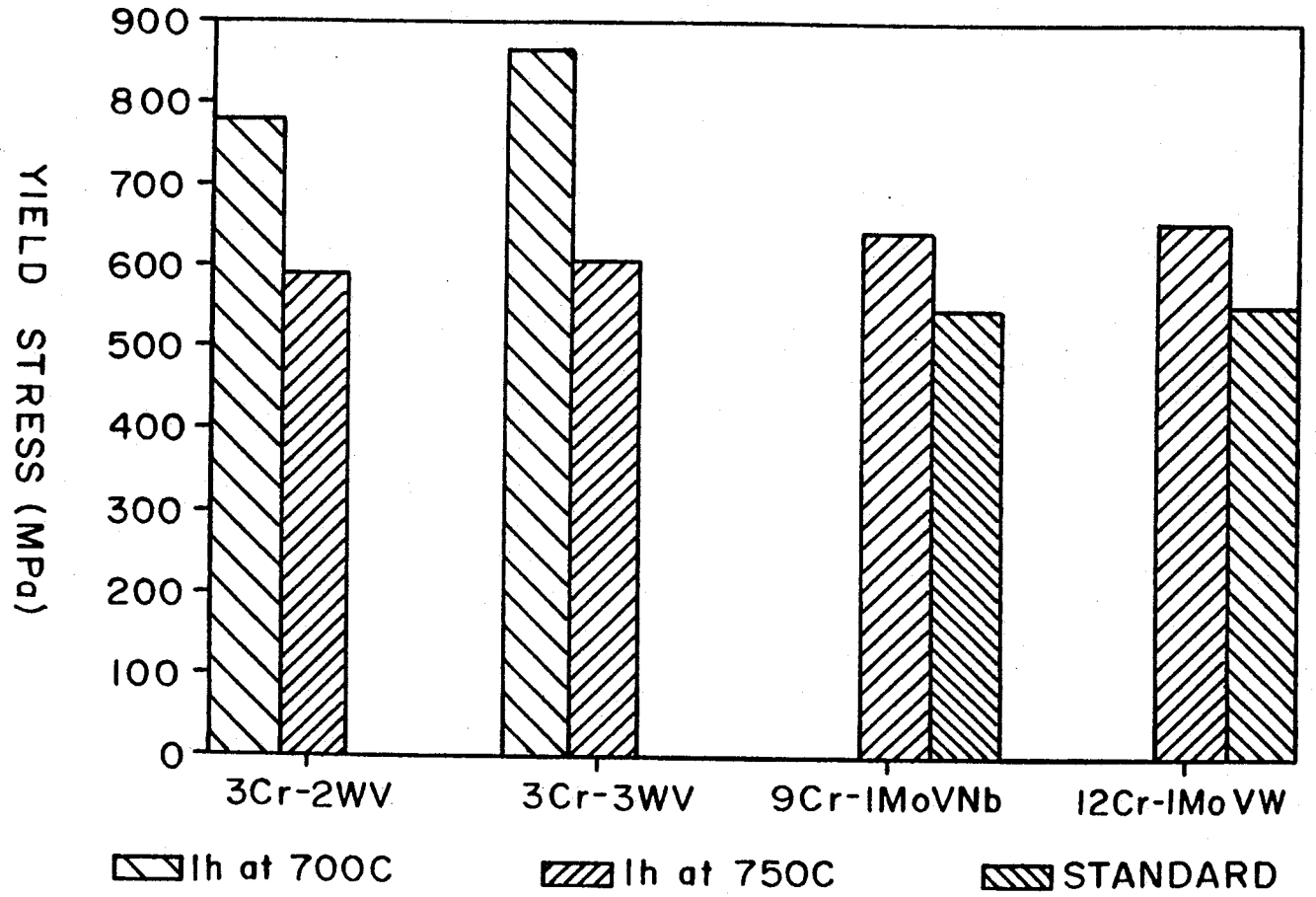
FIGS. 7, 8, and 9 are bar graphs comparing mechanical properties of the steels of the present invention with commercial Cr-Mo steels.

The yield stress (YS) behavior of the 3Cr-2WV and 3Cr-3WV after tempering at 700° C. and 750° C. is compared with the yield stress of the 9Cr-1MoVNb and 12Cr-1MoVW after the standard tempering for 1 hr. at 760° C. and 2.5 hrs. at 780° C., respectively as presented in the graph in FIG. 7. These standard tempering treatments are required for these steels to give them adequate toughness. As shown, the strength of the 3Cr-2WV and 3Cr-3WV steels is comparable to the 9Cr-1MoVNb and 12Cr-1MoVW steels when all four steels were tempered at 750° C. The 3Cr-2WV and 3Cr-3WV steels had a significantly higher strength when tempered at 700° C. than the molybdenum containing steels when tempered at 750° C. or the standard tempering conditions.

Figure 8:
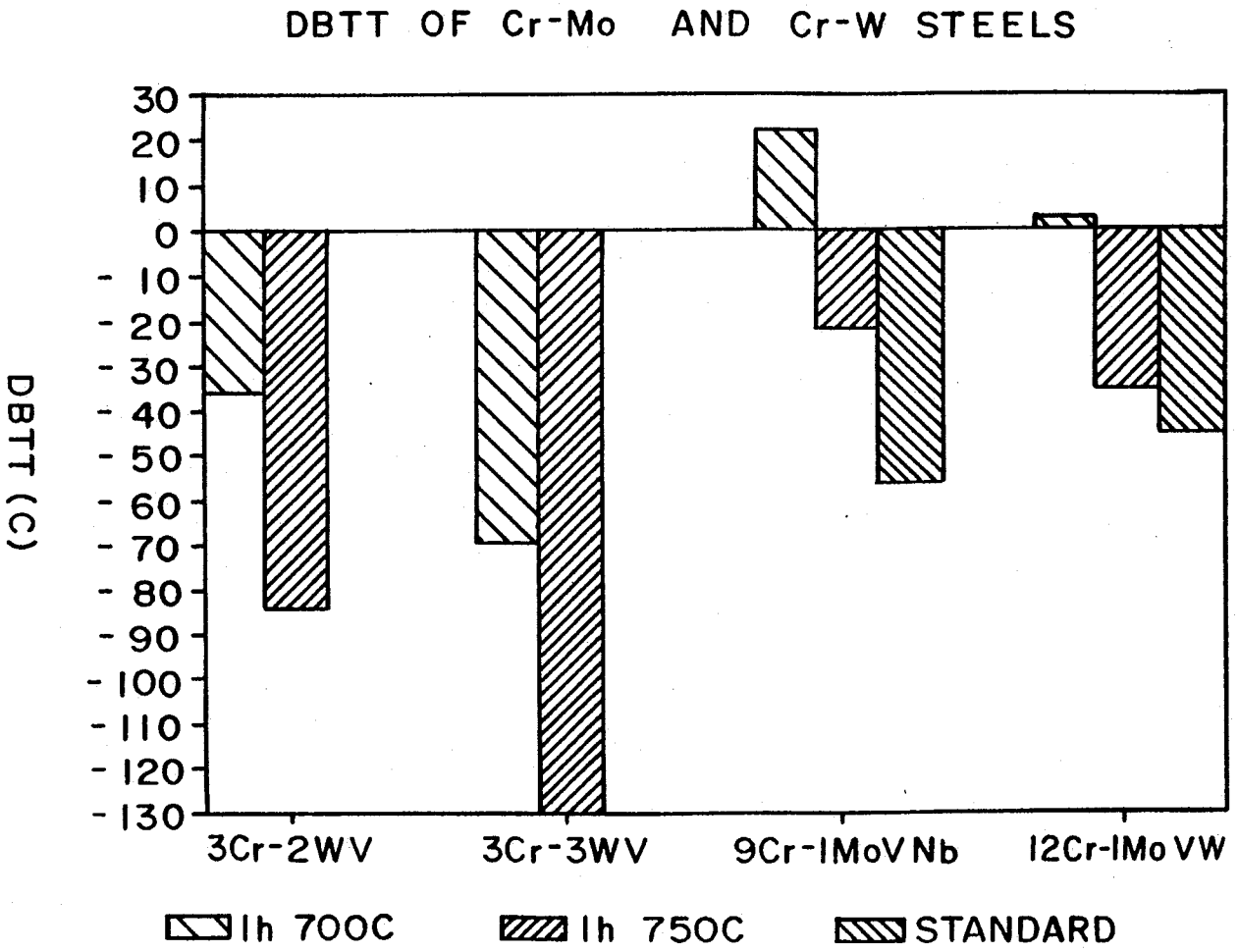
Figure 9:
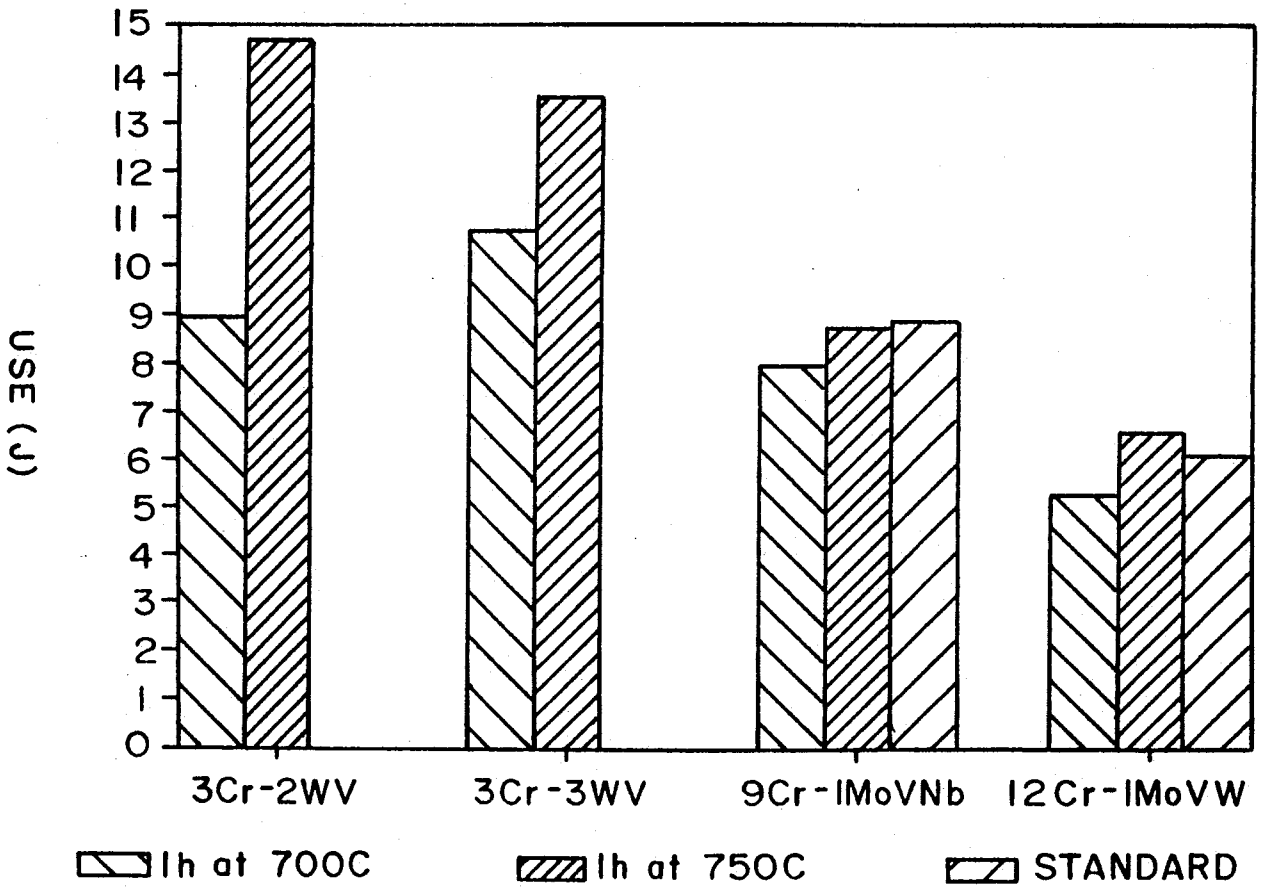

Although the strength of the 9Cr-1MoVNb and 12Cr-1MoVW steels after tempering at 750° C. is slightly greater than that of the 3Cr-2WV and 3Cr-3WV steels, the Charpy impact behavior of the two Cr-W steels is superior to that of the Cr-Mo steels after tempering at both 700° C. and 750° C. as shown in Table 6 and FIGS. 8 and 9. Furthermore, the DBTT and USE of the two Cr-W steels after tempering at 700° C. are superior to those of the Cr-Mo steels tempered at 750° C. Thus, the strength of the 3Cr-2WV and 3Cr-3WV steels will be far superior to that of the Cr-Mo steels. This indicates that the 3Cr-2WV and 3Cr3WV steels can be tempered even less (or not at all) to provide adequate toughness and still provide higher strength, while the Cr-Mo steels can not.

The DBTT behavior for the 3Cr-2WV, 3Cr-3WV, 9Cr-1MoVNb and 12Cr-1MoVW steels after tempering at 700° C. and 750° C. and the 9Cr-1MoVNb and 12Cr-1MoVW steels after tempering at the standard temperature are shown in the graph of FIG. 8. As shown, the DBTT of the 3Cr-2WV and 3Cr-3WV steels after tempering at 700° C. are comparable to the DBTT of the 9Cr-1MoVNb and 12Cr-1MoVW after the standard temper. When the 9Cr-1MoVNb and 12Cr-1MoVW are tempered at 700° C., the DBTT is above 0° C.

In FIG. 9, the USE of the 3Cr-2WV and 3Cr-3WV steels after tempering at 700° C. and 750° C. and the 9Cr-1MoVNb and 12Cr-1MoVW steels after the standard temper are shown. As shown, the 3Cr-2WV and 3Cr-3WV steels after 700° C. and 750° C. have the highest values and when tempered at 700° C. also have a better USE than the 9Cr-1MoVNb and 12Cr-1MoVW steels after the standard temper.

Tables 5 and 6 also give data for the 9Cr-1MoVNb and 12Cr-1MoVW steels after standard tempering treatments. When the 9Cr-1MoVNb and 12Cr-1MoVW steels in these standard heat-treatment conditions are compared with the 3Cr-2WV and 3Cr-3WV steels, the toughness of the 3Cr-2WV and 3Cr-3WV steels after a 700° C. temper still have comparable DBTT and USE values to those of the 9Cr-1MoVNb and 12Cr-1MoVW steels. This standard heat treatment results in a reduced strength of the 9Cr-1MoVNb and 12Cr-1MoVW steels, as shown in Table 5, such that the strengths of the Cr-W steels after tempering a 700° C. far exceed those for the Cr-Mo steels. The 3Cr-2WV and 3Cr-3WV steels also have superior strength properties after being tempered at 750° C. when compared to the Cr-Mo steels after the standard temper.

EXAMPLE III

In this example, the high-temperature strength and ductility of the new steel is compared with that of the commercial high-chromium Cr-Mo steels (these steels have 25–35% higher elevated-temperature strengths than 2.25Cr-1Mo, and thus, no data are given for the latter steel). The comparison is shown in Table 7 for tensile tests at 600° C.

Data are shown for the 2.25Cr-2WV, 3Cr-2WV, and 3Cr-3WV steels tempered at 700° C. and 750° C. and for the 9Cr-1MoVNb and 12Cr-1MoVW steels tempered at 750° C. The 3Cr-3WV steel has properties better than those of the 2.25Cr-2WV after the 700° C. temper, and the properties of both the 3Cr-2WV and 3Cr-3WV steels have comparable strengths and ductilites to the 9Cr-1MoVNb and 12Cr-1MoVW steels when all of the steels are tempered at 750° C. As discussed above, the two Cr-W steels can be used after a temper of 700° C., while the two Cr-Mo steels will have to be given a standard temper. This will give the two Cr-W steels a still larger advantage. Elevated-temperature strength is indicative of creep strength, which is an important property for these steels.

In summary, for the 3Cr-2WV and 3Cr-3WV steels to attain similar or better toughness than the 9Cr-1MoVNb and 12Cr-1MoVW steels, the 3Cr-2VW and 3Cr-3WV do not have to be tempered as severely as the two high-strength Cr-Mo steels. Even with much less tempering, the toughness of the 3Cr-2WV and 3Cr-3WV steels approaches that of 9Cr-1MoVNb and 12Cr-1MoVW steels in their standard temper conditions.

In the examples described above, various processing-fabrication methods such as casting can be used to form a body of the specified composition. Moreover, the composition may include trace amounts of other elements and/or may include minor amounts of elements normally added to steel melts, such as Si and Mn, to achieve certain desirable properties. Strict compositional levels are required for FIRD nuclear fusion applications, but minor or trace levels of various elements can be tolerated or added for non-nuclear applications.

TABLE 7

COMPARISON OF TENSILE DATA AT 600° C. FOR FIRD STEELS AND CONVENTIONAL Cr—Mo STEELS

| | Heat Treatment[a] | | | | | |
|---|---|---|---|---|---|---|
| | Tempered at 700° C. | | | Tempered at 750° C. | | |
| Alloy Designation | YS (MPa) | UTS (MPa) | El (%) | YS (MPa) | UTS (MPa) | El (%) |
| 2.25Cr—2WV | 697 | 750 | 5.3 | 539 | 589 | 5.3 |
| 3Cr—2WV | 638 | 701 | 5.1 | 488 | 566 | 6.5 |
| 3Cr—3WV | 706 | 781 | 5.0 | 498 | 590 | 6.3 |
| 9Cr—1MoVNb | | | | 517 | 563 | 5.4 |
| 12Cr—1MoVW | | | | 506 | 559 | 5.7 |

[a]All steels were normalized and tempered. They were austenitized 0.5 hr. at 1050° C. and tempered 1 hr. at 700° C. and 1 hr. at 750° C.

While these has been shown and described what is at present considered the preferred embodiment of the invention, it will be obvious to those skilled in the art that various changes and modifications may be made therein without departing from the scope of the invention as defined by the appended claims.

What is claimed is:

1. A high strength, high toughness bainitic/ferritic steel alloy comprising about 2.75% to 4.0% chromium, about 2.0% to 3.5% tungsten, about 0.10% to 0.30% vanadium, and about 0.1% to 0.15% carbon with the balance iron, wherein the percentages are by total weight of the composition, wherein the alloy having been heated to an austenitizing temperature and then cooled at a rate sufficient to produce carbide-free acicular bainite.

2. The steel alloy according to claim 1, further comprising about 0.003% to 0.009% boron.

3. The steel alloy according to claim 1, further comprising about 0.05% to 0.15% tantalum.

4. The steel alloy according to claim 1, further comprising up to about 0.2% titanium.

5. The steel alloy according to claim 1, further comprising a minor alloying element selected from the group consisting of boron, tantalum, titanium, niobium, molybdenum, silicon, nitrogen and copper, and ranging in amounts from 0.02 to 0.09%.

6. The steel alloy according to claim 1, comprising 3%Cr, 3%W 0.25%V, and 0.1%C.

7. A method of producing a high strength, high toughness ferritic steel composition comprising the steps of:

forming a body of a ferritic steel composition comprising 2.75wt % to 4.0wt % chromium, 2.0wt % to 3.5wt % tungsten, 0.10wt % to 0.30wt % vanadium, and 0.1 wt % to 0.15wt % carbon with the balance iron;

heating the body to an austenitizing temperature for a predetermined length of time; and cooling the body at a rate sufficient to produce carbide-free acicular bainite.

8. The method of claim 7, wherein said austenitizing temperature is at least 1050° C. and said austenitizing time is at least 0.5 hour.

9. The method of claim 8, said heating step further comprises heating the body in a medium selected from the group consisting of air, vacuum, and an inert atmosphere such as helium.

10. The method of claim 7, wherein said heating step further comprises air cooling said body after heating.

11. The method of claim 7 wherein said cooling step comprises quenching said body in a liquid after heating.

12. The method of claim 7, wherein said austenitizing step further comprises cooling said composition in various heat-treating atmospheres.

13. The method of claim 7, further comprising the step of tempering said body after cooling.

14. The method of claim 7, further comprising tempering said body after cooling at a temperature of less than or equal to 700° C. for not more than about 1 hour.

15. The method of claim 7, wherein the composition includes 3%Cr, 3%W, 0.25%V, and 0.1%C.

16. The method of claim 7, further comprising a minor alloy element selected from the group consisting of boron, tantalum, titanium, niobium, molybdenum, silicon, nitrogen and copper, and ranging in amounts from 0.02 to 0.09%.

17. A method of producing a high strength, high toughness ferritic steel alloy comprising the steps of:

forming a body of a ferritic steel composition comprising 2.75wt % to 4.0wt % chromium, 2.0 wt % to 3.5wt % tungsten, 0.10wt % to 0.30wt % vanadium, 0.1 wt % to 0.15wt % carbon, 0.003wt % to 0.009wt % boron, 0.05wt % to 0.15wt % tantalum and 0.0 to 0.2wt % titanium, 0–0.5wt % Mo, 0.2–0.5wt % Si, 0–0.5wt % Mn, 0.0–0.03wt % N, 0.05–0.25wt % Nb, 30 and 0–0.25wt % Cu;

heating said composition to an austenitizinq temperature; and cooling said composition at a rate to form a carbide-free acicular bainite microstructure; an tempering said composition at a temperature of not more than about 700° C. for not more than 1 hour.

18. The method of claim 17, wherein said cooling step comprises air cooling said composition.

19. The method of claim 17, wherein said cooling step comprises quenching said composition.

20. A high-strength, high-toughness ferritic steel article made according to the method of claim 17.

* * * * *